US006337141B1

(12) United States Patent
Yamada et al.

(10) Patent No.: US 6,337,141 B1
(45) Date of Patent: Jan. 8, 2002

(54) SWASH-PLATE OF SWASH-PLATE TYPE COMPRESSOR

(75) Inventors: Toyokazu Yamada; Soo-Myung Hong; Masanori Akiduki; Takashi Kokubo; Hiroaki Kayukawa; Hideki Mizutani; Manabu Sugiura; Takeshi Imanishi, all of Aichi (JP)

(73) Assignees: Taiho Kogyo Co., Ltd., Toyota; Kabushiki Kaisha Toyoda Jidoshokki Seisakusho, Kariya, both of (JP)

( * ) Notice: Subject to any disclaimer, the term of this patent is extended or adjusted under 35 U.S.C. 154(b) by 0 days.

(21) Appl. No.: 09/464,775

(22) Filed: Dec. 16, 1999

(30) Foreign Application Priority Data

Dec. 17, 1998 (JP) ..... 10-358544

(51) Int. Cl.[7] ..... C23C 4/06; C23C 4/04; F04B 27/08; F04B 27/10

(52) U.S. Cl. ..... 428/553; 428/564; 428/568; 428/569; 428/652; 428/653; 428/654; 428/937; 75/231; 75/249; 92/71

(58) Field of Search ..... 428/553, 564, 428/568, 569, 662, 653, 654, 937, 647, 648, 646; 75/231, 249; 92/71

(56) References Cited

U.S. PATENT DOCUMENTS 5,056,417 A * 10/1991 Kato et al.
5,486,299 A 1/1996 Fuwa et al. ..... 252/12
5,655,432 A * 8/1997 Wilkosz et al.
5,864,745 A * 1/1999 Kawagoe et al.
5,911,809 A * 6/1999 Cordy
6,090,497 A * 7/2000 Mori et al.
6,123,009 A * 9/2000 Kanayama et al.
6,136,454 A * 10/2000 Cordy

FOREIGN PATENT DOCUMENTS

| | | |
|---|---|---|
| EP | 0 713 972 A1 | 5/1996 |
| EP | 0 854 286 A2 | 7/1998 |
| JP | 54-28239 | 3/1979 |
| JP | 59-221479 | 12/1984 |
| WO | WO 99/50556 | 10/1999 |

* cited by examiner

*Primary Examiner*—Blaine Copenheaver
*Assistant Examiner*—Jason Savage
(74) *Attorney, Agent, or Firm*—Armstrong, Westerman, Hattori, McLeland & Naughton, LLP

(57) ABSTRACT

The seizure resistance of an Al-based flame-sprayed layer formed on the swash plate of a swash-plate type comressor is increased to such a level comparable to that of a flame-sprayed bronze layer. The Al-based flame-sprayed layer of the present invention contains: from 12 to 60% of Si and granular Si particles dispersed in the matrix thereof, and at least one dispersing phase of graphite carbon, amorphous carbon and carbon, the crystallizing degree of which is between the graphite carbon and amorphous carbon, and $MoS_2$.

31 Claims, 2 Drawing Sheets

SWASH-PLATE OF SWASH-PLATE TYPE COMPRESSOR

BACKGROUND OF INVENTION

1. Field of Invention

The present invention relates to a swash plate of a swash-plate type compressor, more particularly a swash plate having a surface sliding layer, for which a high Si aluminum alloy with improved sliding properties is used.

2. Background Technique

In the swash-plate type compressor, the swash plate 2 is rigidly secured obliquely to a rotary shaft as shown in FIG. 1. Alternatively, the swash plate is secured obliquely to a rotary shaft in such a manner that its slanting angle is variable. The compression and expansion are carried out by means of rotating the swash-plate which increases or decreases the volume of partition space within a compressor, depending upon the rotation of the rotary shaft. Such swash plate 2 is caused to slide on a shielding member referred to as a shoe 3. Gas-tight sealing between the swash plate 2 and the shoe 3 enables the compression and expansion of the cooling medium in the stated space. 4 is a ball.

A noteworthy point in the sliding conditions of a swash-plate is that, during the initial operational period of a compressor, the cooling medium reaches the sliding part prior to the lubricating oil reaching the sliding part between the swash plate and the shoe; thus the cooling medium has a rinsing effect on the lubricating oil which remains on the sliding part, with the result that the sliding condition is a dry condition free of lubricating oil. The sliding condition requirements of the swash plate are therefore very severe.

The sliding properties, which are required for a swash-plate used under the conditions described above, are seizure resistance, wear resistance, and the like. Proposals have thus been made to add hard matters into the aluminum material for enhancing the wear resistance, to improve the material of the swash plate, and to subject an iron-based swash-plate to heat treatment for enhancing the hardness and hence wear-resistance. In addition, the following surface treating methods are also proposed.

One of the present applicants proposed in Japanese Unexamined Patent Publication No. Sho51-36611 to bond sintered Cu material on the shoe in the case of an iron-based swash plate. That is, an iron-based swash plate was heretofore subjected to hardening treatment. However, when the material of the opposed member, i.e., the shoe, is an iron-based material, the sliding takes place between identical kinds of materials thereby incurring a problem of possible seizure. Sintered copper alloy is used for the opposing material (shoe) opposed to an iron-based swash plate, so as to avoid the above-mentioned problem.

In addition, it was also proposed to apply tin plating on the iron-based swash-plate so as to avoid the sliding between identical kinds of materials and hence to enhance the seizure resistance. Since the tin plating applied on an iron-based swash-plate is soft, a problem that arises is insufficient wear-resistance.

In bronze-based material lead realizes compatiblity and lubrication effects. Improved sliding performance can, therefore, be attained by means of flame-spraying the lead-added bronze (c.f., European Publication No. EP 0713972A1). However, the trend toward using lead-free materials has recently intensified, and, therefore, it is urgently needed to develop sliding material, which can replace the lead-added bronze.

Prior proposals of the surface-treating methods of a swash plate of the swash-plate type compressor cannot attain the properties superior to those attained by the lead-added bronze. From such a point of view, the present inventors turned their attention to flame-spraying of aluminum materials, particularly Al—Si alloy. The Si of the Al—Si alloy crystallizes as the primary crystal or eutectic, with the result that the wear resistance can easily be enhanced. It is, however, difficult to find in the aluminum materials, any component(s), which can outstandingly enhance the seizure resistance.

SUMMARY OF INVENTION

It is, therefore, an object of the present invention to provide a swash plate of a swash-plate type compressor, which can solve the problems involved in the prior art.

No considerations have been given, as far as the present inventors are aware, to flame-spray simultaneously the Al—Si alloy in the eutectic or hyper-eutectic region and a tribological material such as graphite or $MoS_2$. Spraying temperature of 700° C. or higher is necessary for flame-spraying the aluminum-alloys, while active reaction between the graphite and oxygen occurs at a temperature of 500° C. or higher. There is, therefore, a danger that the graphite cannot be incorporated in the flame-sprayed layer, when even a small amount of oxygen is present in the spraying flame. The present inventors recognized, therefore, concern regarding for the combustion and loss of graphite in the flame-spraying gas under the presence of oxygen in such gas. Unexpectedly, the present inventors discovered that tribological materials can be dispersed in the aluminum materials.

In accordance with the objects of the present invention, there is provided a swash plate of a swash-plate type compressor, characterized in that a flame-sprayed layer deposited on the substrate consists of (a) aluminum alloy containing from 12 to 60% by weight of Si and granular Si particles dispersed in the matrix thereof and (b) at least one dispersing phase of graphite carbon, amorphous carbon and carbon, carbon, the crystallizing degree of which is between that of the graphite carbon and amorphous carbon, and $MoS_2$.

The present invention is explained hereinafter in detail. The percentage is weight % unless otherwise specified.

DESCRIPTION OF PREFERRED EMBODIMENTS

The present inventors energetically carried out experiments and discovered that the flame-sprayed Al—Si based aluminum alloys in a eutectic region or a hyper-eutectic region exhibits improved adhesiveness with a substrate; and, the Si particles are refined.

In the flame-sprayed Al—Si based alloy of the present invention, Si in granular form is dispersed in the aluminum matrix finely and in a large amount. Thus, a large amount of granular Si despersed finely in the aluminum matrix enhances the hardness and hence wear-resistance of the alloy. In addition, the granular Si particles disperse finely in a large amount and suppress the adhesion between the aluminum matrix and a shoe and hence seizure due to such adhesion.

EP 0713972A1 filed by the present applicants provides a detailed explanation of the flame-sprayed copper alloy by referring to an example of Cu—Pb alloy. The rapid cooling and solidification of molten particles is common in the Al-alloy example. One feature of the flame-sprayed Al—Si alloy is that an additive element (Si) has a higher melting point than that of the matrix element (Al). As a result, Si in granular form is finely dispersed in the aluminum matrix in a large amount. Thus, the effect is obtained such that Si enhances the hardness and hence wear-resistance of the alloy.

In the present invention, the granular Si particles do not have the same shape as seen in the primary Si of the conventional melted alloy or the Si particles of the rolled alloy. They have a one-directional, lengthwise property. On the other hand, the granular Si particles of the present invention have spheroidal, nodular, polygonal, island-form having concavities or irregular shapes, which are not classified as the former shapes, and have almost the same size in any direction. More specifcally, the ratio of the longest and shortest diameter is 3:1 or less, in average. Furthermore, the marked noteworthy distinction between the primary Si and eutectic Si seen in the conventional melted alloys disappears in the case of the present invention.

When the Si content of the aluminum-alloy according to the present invention is less than 12%, the enhancement effects of wear resistance and are slight. On the other hand, when the Si content exceeds 60%, it is difficult to produce the alloy powder to be flame-sprayed. A preferable Si content is from 15 to 50%. When the size of Si particles exceeds 50 $\mu$m, separation of the Si particles is liable to occur. A preferable size is from 1 to 40 $\mu$m.

In the present invention, an Al—Si—Sn based alloy exhibiting improved wear-resistance and seizure-resistance can be used as the matrix of the flame-sprayed layer. According to the present invention. Sn is uniformly dispersed in the aluminum matrix and imparts the lubricating property and compatibility. Sn preferentially adheres to the shoe and impedes the sliding of materials of the same kind, i.e., Al of a swash plate and Al adhering to the Al of the shoe, with the result that the seizure resistance is enhanced. When the Sn content is less than 0.1%, it is not effective for enhancing the lubricating property and the like. On the other hand, when the Sn content exceeds 30%, the strength of the alloy is lowered. A preferable Sn content is from 5 to 25%. The morphology of the Sn phase in the layer is elongated flaky. This morphology seems to be preferable in the light of the lubricating property.

The aluminum alloy according to the present invention can contain the following optional elements.

Cu: Cu is solid-dissolved in the aluminum matrix at super-saturation and thus enhances its strength. Cu thus suppresses adhesive wear of aluminum and wear due to separation of Si particles. In addition, a part of Cu forms with Sn, a Sn—Cu intermetallic compound and hence enhances the wear-resistance. However, when the Cu content exceeds 8.0%, the alloy is excessively hardened such that appropriate sliding material is not provided. A preferable Cu content is from 0.5 to 5%.

Mg: Mg is combined with a part of Si and forms an Mg—Si intermetallic compound. Mg, thus, enhances the wear resistance. However, when the Mg content exceeds 3.0%, the coarse Mg phase formed impairs the sliding properties.

Mn: Mn is solid-dissolved in the aluminum matrix at super-saturation and thus enhances its strength. The effects attained by Mn are the same as those by Cu. However, when the Mn content exceeds 3.0%, the alloy is excessively hardened such that appropriate sliding material. A preferable Mn content is from 0.1 to 1%.

Fe: Fe is solid-dissolved in the aluminum matrix at super-saturation and thus enhances its strength. The effects attained by Fe are the same as those by Cu. However, when the Fe content exceeds 1.5%, the alloy is hardened excessively such that appropriate sliding material is not provided. A preferable Fe content is from 0.1 to 1%.

Ni: Ni is solid-dissolved in the aluminum matrix at super-saturation and thus enhances its strength. The effects attained by Ni are the same as those by Cu. However, when the Ni content exceeds 8%, the alloy is excessively hardened such that provide appropriate sliding material is not provided. A preferable Ni content is from 1.5% or less.

The flame-spraying (spraying) is based on the definition in Glossary Dictionary of JIS Industrial Terms, 4 th edition, page 1946 and indicates that "material is converted to molten or half-molten state by a heat source and is blown onto a substrate to form a film." The "material" is aluminum-alloy or its raw material, for example, Al and Si powder. The above-referred definition is, however, modified in the sence that the as well as carbonaceous material and/or $MoS_2$ are blown together with the material mentioned above but are not melted essentially. The half-molten state indicates such a state of aluminum-based material that a coexisting solid-liquid state is realized as in a high-Si Al—Si alloy, i.e., a material having high melting-point. The half-molten state indicates that a portion of the powder does not melt, as is explained hereinbelow. In the present invention, various flame-spraying methods listed in FIG. 2 of Tribologist, Vol. 41, No. 11, page 20, FIG. 2 can be employed. Among them, the high-velocity oxyfuel flame-spraying method (HVOF, high velocity oxyfuel) can be preferably employed. It seems that the characterizing morphology of the Si and Sn phases can be obtained by this method, since it has the features described on page 20, right-hand column, lines 4 through 13 of Tribologist, ibid.

Flame-sprayed Al is so rapidly cooled and solidified that a large amount of Si is solid-dissolved to harden Al. It has, therefore, the feature of holding the Si particles at high strength. Separation of Si particles and the wear due to such separation can, therefore, be suppressed.

An atomized powder of alloys such as Al—Si alloy, Al—Si—Sn alloy and the like can be used as the flame-spraying powder. These atomized powders may be completely melted on the substrate and then solidified. Alternatively, a partly unmelted atomized powder may be applied on the substrate, so that the unmelted structure of the powder remains.

The flame-spraying conditions are preferably: from 0.9 to 1.2 MPa of the oxygen pressure; from 0.6 to 0.9 MPa of fuel pressure; and from 50 to 250 mm of flame-spraying distance. A preferable thickness of the flame-sprayed layer is from 10 to 500 $\mu$m, particularly from 10 to 300 $\mu$m.

The hardness of the flame-sprayed alloy is in a range of from Hv100 to 400. Since the hardness of the conventional 12% Si-containing alloy is Hv50 to 150, the flame-sprayed layer according to the present invention can be said to be very hard.

Next, the dispersing phase of the flame-sprayed layer, i.e., the phase dispersed in the aluminum-alloy matrix, is described.

The material of the dispersing phase is flame-sprayed together with the aluminum-alloy powder or the raw-material powder of the aluminum-alloy. The tribological material undergoes neither appreciable combustion nor decomposition in the spray flame of the high-speed oxyfuel flame spraying or the like and is incorporated in the flame-spraying layer.

The carbonaceous material is amorphous carbon, graphite or carbon having a crystallization degree between the former two carbons, or the like. Graphite may be natural or synthesized graphite. The strong cleavage property of the graphite can be utilized to improve the sliding properties. The carbonaceous material having a marked graphite structure exhibits sliding effects due to the cleavage. Meanwhile, when the two-dimensional structure of the carbonaceous material becomes less marked, its effect to improve the wear resistance becomes more pronounced with the result that the sliding properties are improved as well. Since the carbonaceous material is not melted during the flame spraying, the shape of the raw material powder is relatively maintained in such a manner that the carbonaceous material dispersed in the flame-sprayed layer retains the shape of that of the raw material powder.

$MoS_2$, which is the other dispersing phase, is a well known tribological material. It improves the sliding properties of the flame-sprayed layer only slightly under severe sliding condition. $MoS_2$ improves such sliding properties under moderate sliding condition, although not outstandingly as graphite does.

The above mentioned tribological material is preferably from 2 to 40% by weight, more preferably from 5 to 25% by weight based on the flame-sprayed layer. The tribological material has preferably from 10 to 50 $\mu$m, more preferably from 20 to 40 $\mu$m of the average particle diameter prior to the flame-spraying.

Other than the above described aluminum-alloy, carbonaceous material and/or $MoS_2$, such hard matter as FeB, $Fe_3B$, $Al_2O_3$, $SiO_2$, SiC and $Si_3N_4$ can be added to the flame-sprayed layer so as to enhance the wear-resistance. The hard matter is not melted during the flame-spraying and are dispersed in the flame-sprayed alloy. Preferably, the hard matter added is limited to 20% weight or less based on the entire flame-sprayed layer.

Various metal substrates, such as iron, copper, aluminum and the like can be used as the substrate to form a flame-sprayed layer thereon. When the surface of a substrate is roughened by means of shot-blasting and the like, to preferably Rz 10 to 60 $\mu$m of surface roughness, then the adhesive strength of the film can be increased. More specifically, the measurement of adhesive strength of a film by a shear-fracture testing method revealed that: adhesive strength of a flame-sprayed Ni film on the shot-blasted steel substrate was 30 to 50 MPa; while the adhesive strength of the film according to the present invention was 30 to 60 MPa. This is almost the same as that of the flame-sprayed Ni film, which has been heretofore reputed to have good adhesiveness.

Heat treatment can be applied to the flame-sprayed layer to adjust the hardness.

In the case of using the flame-sprayed layer without application of an overlay, the flame-sprayed surface is preferably finished to Rz 3.2 $\mu$m or less.

In the case of using the overlay, various soft coatings exhibiting excellent compatibility, such as a soft metal, e.g., Sn, Pb—Sn, a solid lubricant, e.g., $MoS_2$, graphite and $MOS_2$-graphite, and a mixture of the solid lubricant and resin, can be used. The seizure-resistance can be outstandingly enhanced by a combination of the flame-sprayed layer and the soft coating to such a level that it is superior to that attained by the bronze-based material.

As is described hereinabove, $MoS_2$ of the flame-sprayed layer is only slightly effective under the severe condition free of the ice-machine oil. Contrary to this, $MoS_2$ of the overlay exhibits outstanding effects.

The swash-plate type compressor per se is known for example in U.S. Pat. No. 5,228,379 assigned to one of the applicants.

The shoe brought into sliding contact with a wash plate per se is known. It is shown for example in Japanese Unexamined Patent Publication No. 51-36611 filed by the present applicants. Any material, of which the main component is iron, can be used as the iron-based material. Bearing steel is, however, preferable. In addition, the production method of a shoe is not at all limited. Such techniques as rolling, forging, powder-metallurgy, surface-hardening can be optionally employed.

The present invention is described by way of examples.

EXAMPLES

Example 1

A mixture of 70% of the aluminum-alloy powder having 75 $\mu$m of the average particle diameter and 30% of the graphite powder having 30 $\mu$m of the average particle diameter was prepared. The aluminum alloy powder had a composition of 40% Si-containing Al alloy (A2024). Note that the Si content refers to the aluminum alloy, while the graphite content refers to the raw material of spraying, i.e., the aluminum-alloy powder and the graphite powder. After flame-spraying, the surface composition of sliding layer was 85% of the 40% Si-containing Al alloy (A2024). and 15% of the graphite.

Meanwhile, commercially available pure-aluminum rolled sheets were subjected to shot-blasting by steel grids (0.7 mm of size) to roughen the surface to Rz 45 $\mu$m.

Using an HVOF type flame-spraying machine (DJ, product of Sulzer Meteco Co., Ltd.) the flame spraying was carried out under the following conditions.

Oxygen pressure: 1.0 MPa

Fuel pressure: 0.7 MPa

Flame-spraying distance: 180 mm

Thickness of flame-sprayed layer: 200 $\mu$m

Figure 1:
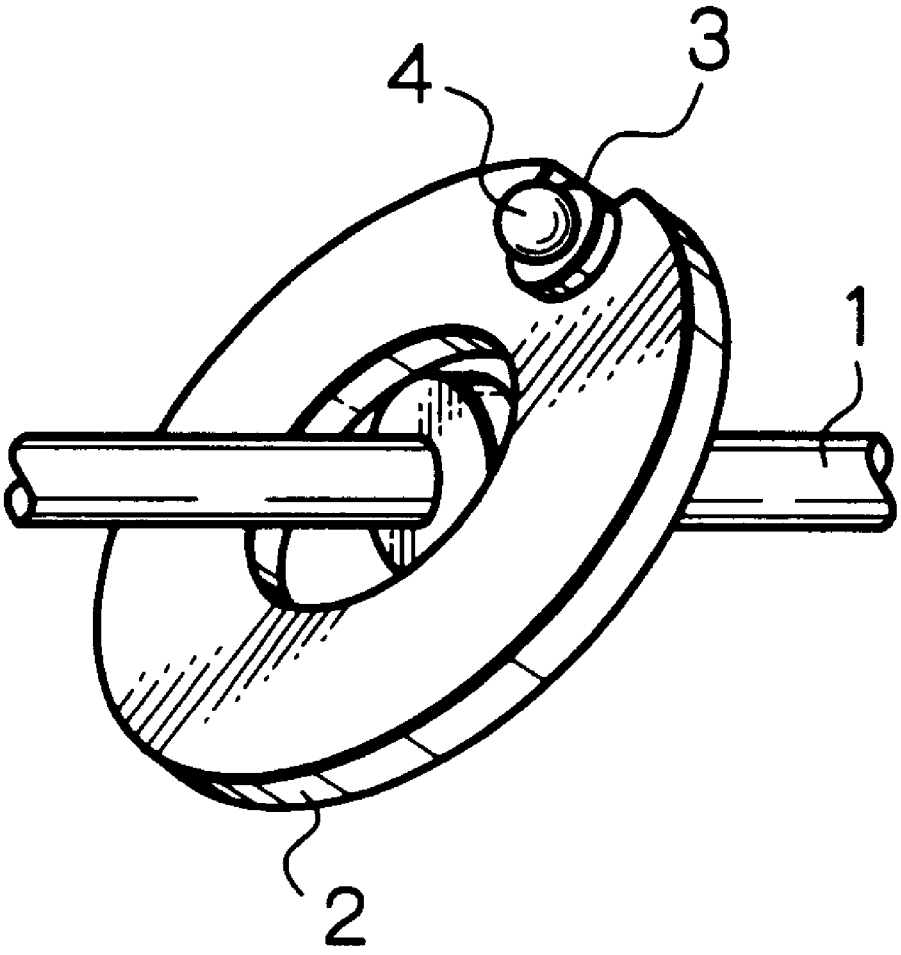
FIG. 1 is a schematic drawing a swash plate.
Figure 2:
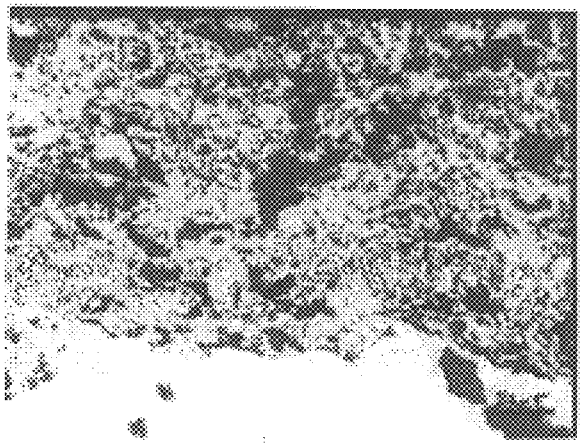
FIG. 2 is a photograph showing the microscopic structure of the flame-sprayed layer according to Example 1 (magnification at 400).
Figure 3:
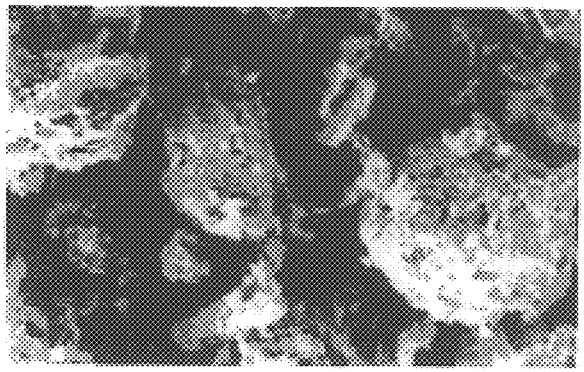
FIG. 3 illustrates the shape of graphite powder (30 $\mu$m of the average particle diameter) used in the flame-sprayed layer shown in FIG. 2.

The resultant flame-sprayed layer had hardness of $Hv_{0.3}$= 166, and average size of granular Si particles of 5 $\mu$m. The microscope-structure photograph is shown in FIG. 2. The enlarged photograph of the graphite before flame-spraying is shown in FIG. 3. The Si particles are granular as shown in FIG. 2. It is clear from FIGS. 2 and 3 that most of the graphite powder passes through the spray flame, impinges upon the substrate, and is fixed by the aluminum-alloy matrix which surrounds the graphite powder upon solidification. The graphite powder collapses upon impingement on the substrate. The observation of C-$K_\alpha$image and microscopic photography revealed that C was detected in the C-$K_\alpha$image at a grain boundary of aluminum. This boundary is coincident in high probability to the site where graphite was detected in the microscopic photograph.

The surface of the flame-sprayed layer was finished to Rz 1.2 $\mu$m. The wear test was then carried out under the following conditions using a steel plate (the quenched SUJ2 as the opposite material). The material provided with the flame-sprayed layer was wrought as a swash plate of a swash-plate type compressor and was mounted in an actual machine. Evaluation under liquid compression was, then, carried out. The result of the test is shown in Table 1, together with the test results of Comparative Examples 1 and 2 as well as Reference Example 1. The seizure did not occur at the cycles shown in Table 1.

Comparative Example 1

The flame-sprayed layer was formed by the same composition as Example 1 except for the graphite omitted, under the same conditions as in Example 1. The resultant flame-sprayed layer had hardness of $Hv_{0.3}$=183, and average size of granular Si particles of 6 $\mu$m.

Comparative Example 2

The flame-sprayed layer was formed by the same composition as Example 1 except that the graphite was replaced with 14% of $MoS_2$, under the same conditions as in Example 1.

Reference Example 1

A 5 $\mu$m-thick overlay (the coating of $MoS_2$ bonded by polyimide) was formed on the flame-sprayed layer of Comparative Example 1.

The liquid compression test was carried out under the following conditions.

Testing machine: a swash-plate type compressor

Number of revolution: 6500 rpm

Testing time: 5 minutes (one cycle)

Testing temperature: −10° C.

In the liquid compression test, the cooling medium exposes the sliding portions to a more severe sliding condition than does the actual cooling medium whereby the damage of the sliding portions is evaluated.

TABLE 1

| | Cycles |
|---|---|
| Example 1 | 20 |
| Comparative Example 1 | 1 |
| Comparative Example 2 | 3 |
| Reference Example 1 | 25 |

As is shown in Table 1, the cycle of Example 1, in which the graphite is dispersed in the flame-sprayed aluminum alloy, is as high as twenty times that of Comparative Example 1. The cycle of Comparative Example 2, in which the $MoS_2$ is dispersed in the flame-sprayed aluminum-alloy, is not very high as compared with that of Example 1. Like this, the influence upon the sliding properties is different depending upon the individual one among the tribological materials.

The sliding properties of Reference Example ($MoS_2$ overlay) 1 is the most excellent in the examples given in Table 1. This indicates differences of the sliding properties between the $MoS_2$ present in the flame-sprayed layer (Comparative Example 2) and $MoS_2$ present in the overlay (Reference Example 1), amounting to as high as about ten times.

Example 2

The sample prepared in Example 1 was subjected to the following successive load-increasing test to evaluate the seizure resistance. The test result is shown in Table 2 together with the test result of Example 3 and Comparative Example 3.

Example 3

The flame sprayed layer was prepared by the method of Example 1, except that the graphite was replaced with 14% $MoS_2$ and further 10% of Sn was additionally added to the aluminum alloy. The prepared flame-sprayed layer was subjected to the successive load-increasing test.

Comparative Example 3

The flame sprayed layer was prepared by the method of Example 1, except that the graphite was omitted and further 20% of Mo was additionally added to the aluminum alloy. The prepared flame-sprayed layer was subjected to the successive load-increasing test. The prepared flame-sprayed layer was subjected to the successive load-increasing test.

The successive load-increasing test was carried out under the following conditions.

Testing machine: a high-pressure gas-media tester

Load: successive increase by 20 kgf/30 minutes

Number of revolution: 7200 rpm

Lubrication: oil/cooling media circulation

TABLE 2

| | Seizure Load ($kgf/mm^2$) |
|---|---|
| Example 2 | 100 |
| Example 3 | 80 |
| Comparative Example 3 | 40 |

The seizure resistance of Comparative Example 3 is poor, notwithstanding the wear resistance and the seizure resistance enhance by means of adding a large amount of Mo. The seizure resistance of Examples 2 and 3, in which the graphite is added, is twice or more as high as that of Comparative Example 3.

As is described hereinabove, the carbonaceous material such as the graphite or $MoS_2$ and the high Si—Al alloy are simultaneously flame-sprayed in accordance with the present invention. The sliding properties of a swash plate according to the present invention is free of lead and is superior to the conventional swash plate on which the bronze is flame-sprayed.

What is claimed is:

1. A swash plate of a swash-plate compressor, comprising:

a substrate; and a flame-sprayed layer deposited on said substrate and consisting of (a) aluminum alloy containing from 12 to 60% by weight of Si and granular Si particles dispersed in the matrix thereof; and (b) at least one dispersing phase selected from the group consisting of graphite carbon, amorphous carbon, partially crystalized amorphous carbon, and $MoS_2$.

2. A swash plate of a swash-plate compressor according to claim 1, wherein said aluminum alloy further contains from 0.1 to 30% by weight of Sn.

3. A swash plate of a swash-plate compressor according to claim 1 or 2, wherein said aluminum alloy further contains at least one element selected from the group consisting of:

8.0% by weight or less of Cu; 3.0% by weight or less of Mg; 3.0% by weight or less of Mn, 1.5% by weight or less of Fe, and 8.0% by weight or less of Ni.

4. A swash plate of a swash-plate compressor according to claim 3, wherein the balance of the aluminum alloy is Al and unavoidable impurities.

5. A swash plate of a swash-plate compressor according to claim 1 or 2, wherein said at least one dispersing phase is graphite.

6. A swash plate of a swash-plate compressor according to claim 5, wherein said aluminum alloy further contains at least one element selected from the group consisting of: 8.0% by weight or less of Cu; 3.0% by weight or less of Mg; 3.0% by weight or less of Mn, 1.5% by weight or less of Fe, and 8.0% by weight or less of Ni.

7. A swash plate of a swash-plate compressor according to claim 1 or 2, wherein said granular Si particles have 50 $\mu$m or less of average particle diameter.

8. A swash plate of a swash-plate compressor according to claim 7, wherein said aluminum alloy further contains at least one element selected from the group consisting of: 8.0% by weight or less of Cu; 3.0% by weight or less of Mg; 3.0% by weight or less of Mn, 1.5% by weight or less of Fe, and 8.0% by weight or less of Ni.

9. A swash plate of a swash-plate compressor according to claim 8, wherein said at least one dispersing phase is graphite carbon.

10. A swash-plate of a swash-plate compressor according to claim 1 or 2, wherein (a) said aluminum alloy amounts to from 60 to 99% by weight, the balance being (b) at least one dispersing phase of graphite carbon, amorphous carbon, carbon, the crystallizing degree of which is between that of the graphite carbon and amorphous carbon, and $MoS_2$.

11. A swash plate of a swash-plate compressor according to claim 10, wherein said aluminum alloy further contains at least one element selected from the group consisting of: 8.0% by weight or less of Cu; 3.0% by weight or less of Mg; 3.0% by weight or less of Mn, 1.5% by weight or less of Fe, and 8.0% by weight or less of Ni.

12. A swash plate of a swash-plate compressor according to claim 11, wherein said dispersing phase is graphite carbon.

13. A swash plate of a swash-plate compressor according to claim 1 or 2, wherein the flame sprayed layer is formed by high-velocity oxyfuel method.

14. A swash plate of a swash-plate compressor according to claim 13, wherein said at least one dispersing phase is selected from the group consisting of graphite carbon, amorphous carbon, carbon, the crystallizing degree of which is between that of the graphite carbon and amorphous carbon, and $MoS_2$.

15. A swash plate of a swash-plate compressor according to claim 14, wherein said granular Si particles have 50 $\mu$m or less of average particle diameter.

16. A swash plate of a swash-plate compressor according to claim 15, wherein said aluminum alloy further contains at least one element selected from the group consisting of: 8.0% by weight or less of Cu; 3.0% by weight or less of Mg; 3.0% by weight or less of Mn, 1.5% by weight or less of Fe, and 8.0% by weight or less of Ni.

17. A swash plate of a swash-plate compressor according to claim 16, wherein said at least one dispersing phase is graphite carbon.

18. A swash plate of a swash-plate compressor, comprising:

a substrate;

a flame-sprayed layer deposited on said substrate and consisting of (a) aluminum alloy containing from 12 to 60% by weight of Si and granular Si particles dispersed in the matrix thereof, and (b) at least one dispersing phase of graphite carbon, amorphous carbon, partially crystallized amorphous carbon, and $MoS_2$; and, a coating formed on said flame-sprayed layer.

19. A swash-plate of a swash-plate compressor according to claim 18, wherein said alminum alloy further contains from 0.1 to 30% by weight of Sn.

20. A swash plate of a swash-plate compressor according to claim 19 wherein said coating consists of said material and resin as a binder.

21. A swash plate of a swash-plate compressor according to claim 20 wherein said coating consists of said material and resin as a binder.

22. A swash plate of a swash-plate compressor according to claim 21, wherein said at least one dispersing phase is graphite carbon and said solid lubricant is $MoS_2$.

23. A swash plate of a swash-plate compressor according to claim 20, wherein said aluminum alloy further contains at least one element selected from the group consisting of: 8.0% by weight or less of Cu; 3.0% by weight or less of Mg; 3.0% by weight or less of Mn, 1.5% by weight or less of Fe, and 8.0% by weight or less of Ni.

24. A swash plate of a swash-plate compressor according to claim 23, wherein said granular Si particles have 50 $\mu$m or less of average particle diameter.

25. A swash plate of a swash-plate compressor according to claim 24, wherein said at least one dispersing phase is graphite carbon, and said solid lubricant is $MoS_2$.

26. A swash plate of a swash-plate compressor according to claim 25, wherein the balance of the aluminum alloy is Al and unavoidable impurities.

27. A swash-plate of a swash-plate compressor according to claim 18 or 19, wherein the flame sprayed layer is formed by high-velocity oxyfuel method.

28. A swash plate of a swash-plate compressor according to claim 27, wherein wherein said aluminum alloy further contains at least one element selected from the group consisting of: 8.0% by weight or less of Cu; 3.0% by weight or less of Mg; 3.0% by weight or less of Mn, 1.5% by weight or less of Fe, and 8.0% by weight or less of Ni.

29. A swash plate of a swash-plate compressor according to claim 28, wherein said granular Si particles have 50 $\mu$m or less of average particle diameter.

30. A swash plate of a swash-plate compressor according to claim 29, wherein said at least one dispersing phase is graphite.

31. A swash plate of a swash-plate compressor as recited in claim 18, wherein the coating formed on said flame-sprayed layer comprises material selected from the group consisting of Sn, Pb—Sn, solid lubricant and solid lubricant bonded with resin.

* * * * *